US012285107B2

(12) United States Patent
Ozagir

(10) Patent No.: US 12,285,107 B2
(45) Date of Patent: Apr. 29, 2025

(54) ADJUSTABLE POST ASSEMBLY

(71) Applicant: FLAT PTY LTD, New South Wales (AU)

(72) Inventor: Ozcan Ozagir, Owestry (GB)

(73) Assignee: FLAT PTY LTD, Chatswood (AU)

( * ) Notice: Subject to any disclaimer, the term of this patent is extended or adjusted under 35 U.S.C. 154(b) by 0 days.

(21) Appl. No.: 18/027,937

(22) PCT Filed: Sep. 23, 2021

(86) PCT No.: PCT/AU2021/051116
§ 371 (c)(1),
(2) Date: Mar. 23, 2023

(87) PCT Pub. No.: WO2022/061412
PCT Pub. Date: Mar. 31, 2022

(65) Prior Publication Data

US 2023/0371684 A1 Nov. 23, 2023

(30) Foreign Application Priority Data

Sep. 23, 2020 (AU) ..... 2020903421

(51) Int. Cl.
*A47B 9/10* (2006.01)
*A47B 9/20* (2006.01)
*A47B 13/00* (2006.01)

(52) U.S. Cl.
CPC ..... *A47B 9/10* (2013.01); *A47B 9/20* (2013.01); *A47B 13/003* (2013.01); *A47B 2013/006* (2013.01); *A47B 2200/0052* (2013.01)

(58) Field of Classification Search
CPC ..... A47B 13/003; A47B 2013/006; A47B 2200/0052; A47B 9/10; A47B 9/20
See application file for complete search history.

(56) References Cited

U.S. PATENT DOCUMENTS 3,887,155 A 6/1975 Bertalot
6,378,816 B1 4/2002 Pfister
(Continued)

FOREIGN PATENT DOCUMENTS

EP 0111439 6/1984
JP S5915343 1/1984
TW M596564 6/2020

OTHER PUBLICATIONS

International Search Report for PCT/AU2021/051116, mailed Nov. 29, 2021.

(Continued)

*Primary Examiner* — Matthew W Ing
(74) *Attorney, Agent, or Firm* — Joseph E. Maenner; Maenner & Associates, LLC

(57) ABSTRACT

An extendable support system for supporting an object on a surface, the support system comprising a support structure comprising an inner post and an outer post arranged such that the relative longitudinal position of the inner post and the outer post effects a change in an overall length of the support structure to vary the height of the object above the surface; a guide assembly comprising one or more guides positioned between the inner post and the outer post, the guides being configured to maintain the lateral position of the inner post and the outer post with respect to one another while allowing longitudinal movement of the inner post and outer post with respect to one another along the length of the support structure.

12 Claims, 7 Drawing Sheets

(56) References Cited

U.S. PATENT DOCUMENTS

| | | | | |
|---|---|---|---|---|
| 6,615,744 | B1 * | 9/2003 | Eckstein | A47B 23/046<br>108/143 |
| 10,702,058 | B1 * | 7/2020 | Wang | A47B 9/20 |
| 2014/0346817 | A1 * | 11/2014 | Tseng | A47C 4/42<br>297/16.1 |

OTHER PUBLICATIONS

International Preliminary Report on Patentability for PCT/AU2021/051116, mailed Jan. 19, 2023.

* cited by examiner

ADJUSTABLE POST ASSEMBLY

TECHNICAL FIELD

This disclosure relates to an assembly for supporting an object at an elevated level above a surface. The disclosure is particularly related to an adjustable post assembly that can support an object such as a table top or other furniture such as seating above the ground, the post assembly utilising a pressurised fluid such as air or another gas to allow the height of the object to be adjusted.

BACKGROUND ART

It is to be understood that, if any prior art is referred to herein, such reference does not constitute an admission that the prior art forms a part of the common general knowledge in the art, in Australia or any other country.

While the assembly is discussed in relation to adjustable height tables, the person skilled in the art will be aware that the post may be utilised to support other objects including other furniture such as seating or any object where adjustment of the height of the object above a surface is beneficial.

Furniture including tables is used everywhere around us in a variety of situations to provide a surface capable of supporting the weight of items or people placed on the surface at an elevation from a lower surface such as the ground. The ability to adjust the elevation of the furniture and align multiple upper surfaces of furniture at the same elevation are useful features to have as they allow furniture to be employed for a multitude of applications such as hospitality, medical or numerous other industries. For example, in a restaurant, there would be a need for tables that can be arranged to serve a buffet, act as a bar table to serve drinks or for dining purposes. Furthermore, there may be regulations that require tables to be of a certain height to accommodate for example wheel chair bound patrons. All the above functions would require the table surfaces to be located at different elevations with respect to the ground surface. Similarly, while attempting to arrange a buffet, multiple tables may need to be brought together at the same elevation so as to obtain a longer surface with more area wherein the different food items may be placed. This is additionally complicated by uneven or sloping surfaces or stepped ground surfaces.

Many furniture models do not have the ability to adjust the elevation of the upper surface or table surface in an easy manner. This means that restaurants or other facilities need to be equipped with multiple types of tables or seating or other surfaces to cater to different functions. This may result in increased costs for the owners in terms of purchasing different furniture. This also means that there needs to be a storage space for the different types of furniture inside the facility. This space could be significant depending on the size of the furniture and the overall area available for the facility.

Tables and furniture items that allow height adjustment are known in the art. However, these usually allow adjustments only to fixed height(s) or a number of fixed heights or require significant manual effort in order to change the elevation. Thus, it may be time consuming to make the height adjustments. In addition some tables or furniture items offer electrical adjustment that allow for variable and quick height adjustment. However, these may be costly due to the associated electrical motor and other components required to impart the functionality. Moreover, electrically assisted tables generally need power sources which would reduce/eliminate the flexibility of locating them anywhere as required and may be dangerous, particularly in environments where the tables may get wet.

Furthermore, aligning multiple tables to obtain a longer surface with more area after elevating different tables to the same height may result in alignment issues that can lead to unevenness of the surface and defeat the purpose of aligning tables together.

Many tables on the market are easily assembled and separated into different components such as the table top, legs, base etc. Given this type of modularity, there is benefit to providing a system that can be retrofitted onto a variety of table tops and/or bases in order to provide a system whose height could be adjusted to any desired level.

One or multiple of the benefits of efficient, varied, supported and retrofittable adjustment would be of benefit in the field.

SUMMARY

In some forms, disclosed is an extendable support system for supporting an object on a surface, the support system comprising a support structure comprising an inner post and an outer post arranged such that the relative longitudinal position of the inner post and the outer post effects a change in an overall length of the support structure to vary the height of the object above the surface; a guide assembly comprising one or more guides positioned between the inner post and the outer post, the guides being configured to maintain the lateral position of the inner post and the outer post with respect to one another while allowing longitudinal movement of the inner post and outer post with respect to one another along the length of the support structure.

In some forms the guides comprise rollers aligned to allow longitudinal movement of the inner post with respect to the outer post along a length of the support structure. In some forms the rollers are cylindrical in shape. In some forms the cylindrical rollers are oriented transverse to a longitudinal length of the support. In some forms the one or more guides are made from a polymeric, metallic or a ceramic material. In some forms the guides are spaced apart around an internal surface of the outer post. In some forms the guides are located proximal an upper end of the outer post and proximal a lower end of the outer post. In some forms the guides are floating along at least a portion of the length of the outer post. In some forms the guide assembly comprises of guides that are fixed to an internal surface of the outer post.

Further disclosed is an extendable support system including an actuator adapted to actuate a change in the relative longitudinal position of the inner post and the outer post effecting a change in an overall length of the support structure to vary the height of the object above the surface, the actuator requiring more than one movement to actuate the change in the relative longitudinal position of the inner post and the outer post. In some forms the movements required of the actuator occur in different directions from one another. In some forms the actuator includes a lever and a release mechanism. In some forms the mechanism is a release pin. In some forms the mechanism is a slide mechanism. In some forms the lever cannot be actuated unless the release mechanism is released. In some forms the release mechanism is in one direction and the actuator mechanism is actuated in a different direction. In some forms those directions are perpendicular to one another.

In some forms the release mechanism is spring loaded or otherwise biased into a closed configuration.

The support system disclosed has the advantages of providing a smooth extension of a support post from minimum to maximum height with controlled pneumatic or other fluid/air controlled movement supported by guides and actuated by the actuator. In addition, the system in some forms includes an actuator with a safety mechanism in the form of a secondary movement required. In some forms the secondary movement is at an angle to the first movement. In some forms the secondary movement is generally transverse or orthogonal to the first movement.

BRIEF DESCRIPTION OF THE DRAWINGS

Embodiments will now be described by way of example only, with reference to the accompanying drawings in which.

DETAILED DESCRIPTION

Figure 3:
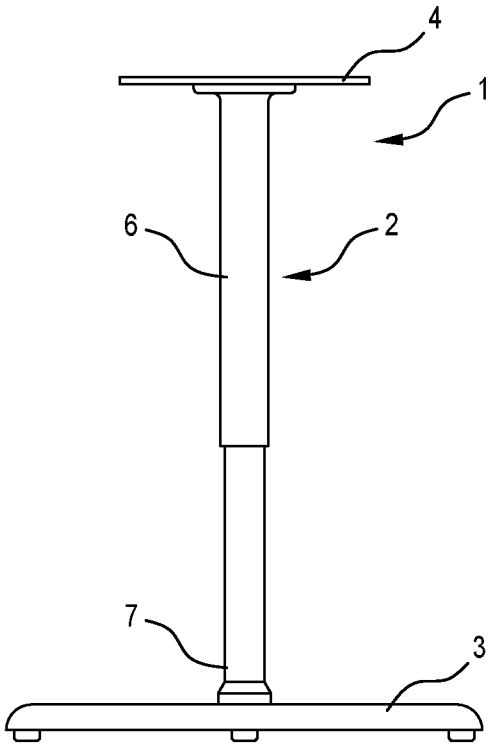
FIG. 3 shows a side view of the embodiment of FIG. 1 in an expanded position.

In the following detailed description, reference is made to accompanying drawings which form a part of the detailed description. The illustrative embodiments described in the detailed description, depicted in the drawings and defined in the claims, are not intended to be limiting. Other embodiments may be utilised, and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

In some forms, disclosed is an extendable support system for supporting an object on a surface, the support system comprising a support structure comprising an inner post and an outer post arranged such that the relative longitudinal position of the inner post and the outer post effects a change in an overall length of the support structure to vary the height of the object above the surface; a guide assembly comprising one or more guides positioned between the inner post and the outer post, the guides being configured to maintain the lateral position of the inner post and the outer post with respect to one another while allowing longitudinal movement of the inner post and outer post with respect to one another along the length of the support structure.

The system has the benefit of providing simple and accessible adjustment of the height of an object. In some forms the object is a table top.

In some forms, the guides comprise rollers aligned to allow longitudinal movement of the inner post with respect to the outer post along a length of the support structure. In some forms, the rollers are cylindrical in shape. In some forms the one or more guides are made from a polymeric, metallic or a ceramic material. In some forms the guides are spaced apart around an internal surface of the outer post. In some forms the guides are located proximal an upper end of the outer post and proximal a lower end of the outer post. In some forms the guides are floating along at least a portion of the length of the outer post. In some forms the guide assembly comprises of guides that are fixed to an internal surface of the outer post.

In some forms the guides comprise a plurality of guides spaced apart about the post in multiple guide arrays, each guide array comprising at least 2 guides.

In some forms the system further comprises an actuator adapted to actuate movement of the inner post with respect to the outer post, the actuator requiring at least a first and a second actuation motion by a user.

In some forms, the actuator requires a first actuation motion in a first direction and a second actuation motion in a second direction. In some forms, the first direction and the second direction are transverse to one another. In some forms, the first actuation motion comprises movement of a release pin. In some forms, the first actuation motion and the second actuation motion can be performed by a single hand.

In some forms a single actuator is configured to be connected to more than one support structure to actuate movement in those support structures.

Figure 2:
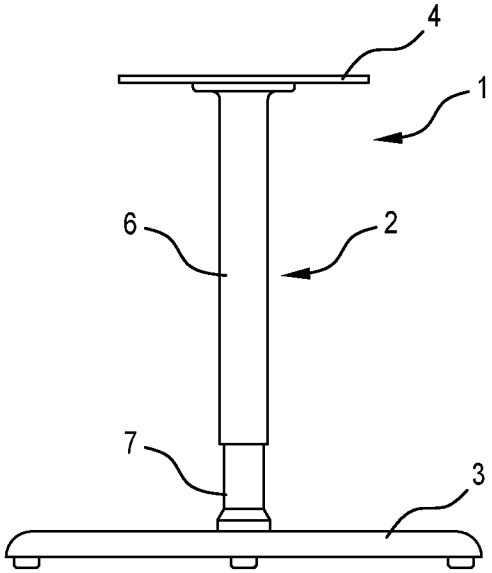
FIG. 2 shows a side view of the embodiment of FIG. 1 in an intermediate position.
Figure 1:
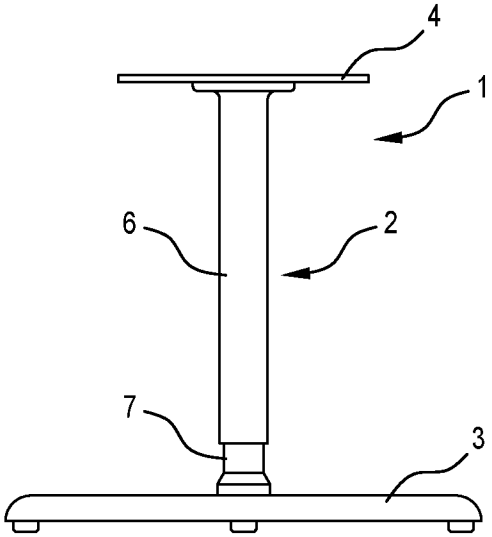
FIG. 1 shows a side view of an embodiment of the disclosure in a contracted position.

Referring to FIGS. 1-3, disclosed in some embodiments is an extendable support system 1 for supporting an object above a surface such as, for example, the floor or ground. The extendable support system 1 comprises a support structure 2 which is configured to extend between a base 3 and a top plate 4, however it will be clear that alternative configurations fall within the scope of the disclosure.

The support structure 1 comprises an outer post 6, which can be round, square, rectangular, hexagonal or any other cross sectional shape, and an inner post 7, the inner post being located within the outer post and in some forms having the same cross sectional shape as the outer post. In the illustrated form the outer post and the inner post are in the form of a cylinder with a circular cross section. Alternatively, the inner and outer posts may be made from longitudinal structures whose cross sections include square, hexagon etc. These would offer different levels of load supporting capabilities. Movement of the outer post and inner post with respect to one another along a longitudinal axis of the support system extends the overall height of the support structure. In the illustrated form, the outer post and inner post telescope with respect to one another meaning more of the inner post is positioned external to the outer post when the support structure is extended to a maximum height, while more of the inner post is located within the outer post when the support structure is contracted to a minimum height.

FIG. 1 shows the support system in a contracted or minimum height form. FIG. 2 shows the support system in an intermediate position. FIG. 3 shows the support system in an extended or maximum height form.

Figure 4:
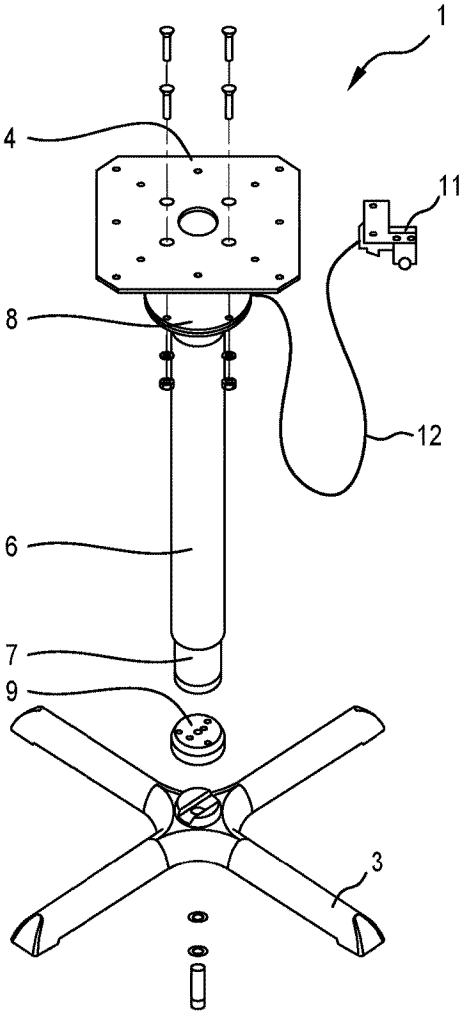
FIG. 4 shows a perspective exploded view of one embodiment of the disclosure.

Referring now to FIG. 4, a perspective view of the support system 1 is shown. The support system comprises a support structure 2 comprising an outer post 6 and an inner post 7 extending between a base 3 and a top plate 4. The top plate 4 is connected to or engaged with the outer post 6 via a connector plate 8 which may be integrally formed with the outer post 6. In some forms the connector plate may be used as a top plate.

The top plate 4 in the illustrated form, acts as a surface that contacts the lower surface of an object such as a table top (not shown) and supports that object. The top plate 4 may be engaged with the outer post 6 and may be connected to the outer post in an integral manner. Alternatively, the top plate 4 may be connected to the outer post via suitable connectors including a connector plate 8. The connector plate 8 and the top plate 4 may each take any shape suitable such as square, rectangular, circular etc. depending on the nature of the object to be supported.

The base 3 is connected with the inner post 7 by means of a base connector 9. The use of a base connector allows the system to be retrofitted to existing standard bases.

As shown in FIG. 4, an actuator 11 is connected to the support system 1 via a communication tube 12 such as a gas tube. The actuator 11 is adapted to control the height of the support system 1 by opening a valve which allows the inner post and outer post to move with respect to one another. In the illustrated form, the inner post and outer post form a sealed telescoping unit which is configured to extend on upward pressure and contract on downward pressure.

While the inner post in the illustrated form is the lower part of the support structure and connected with the base and the outer post in the illustrated form is the upper structure and connected with the object, it will be clear that alternative configurations are available.

Figure 5:
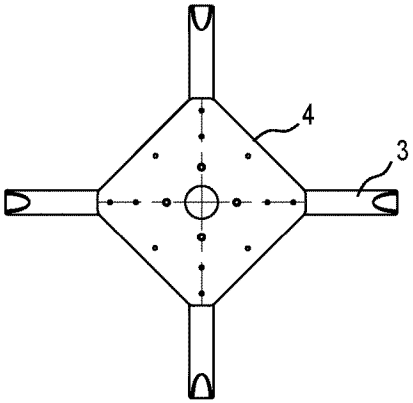
FIG. 5 shows a top view of the embodiment of FIG. 4.
Figure 6:
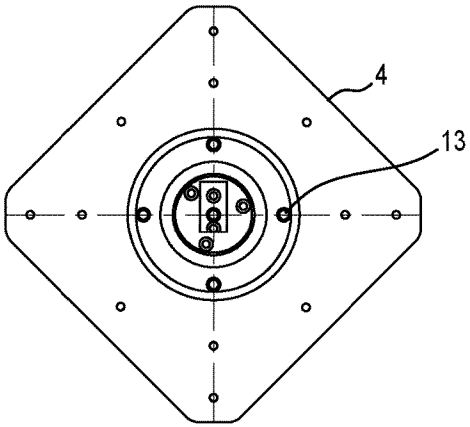
FIG. 6 shows a bottom view of a top plate shown in FIG. 4.

Referring to FIG. 5, a top view of the support system shows the top plate 4 and the base 3. Referring to FIG. 6, a base view of the top plate shows the connection between the top plate 4 and the outer post 6 through use of one or more connectors 13.

Figure 7:
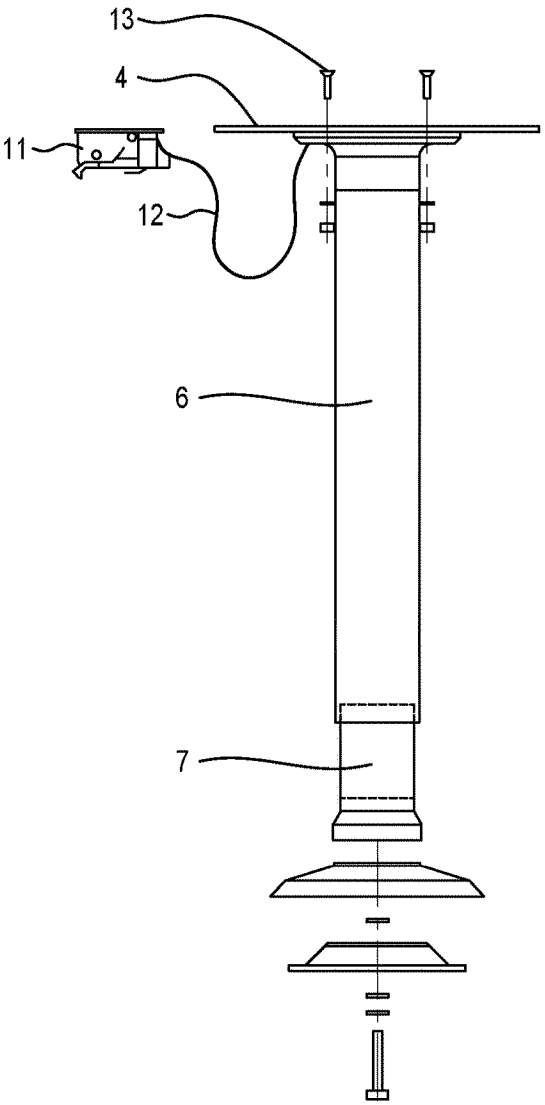
FIG. 7 shows a side exploded view of the embodiment of FIG. 4.

Referring to FIG. 7, the actuator 11 comprises a multiple step actuator. Actuation of the actuator effects extension or contraction of the support structure and raising or lowering of the object located on the support structure such as the table top. In some forms a pressurized gas cylinder is located inside the post or otherwise associated with the post. Actuation of the actuator in the form of the handle opens a valve to and from the pressurized gas cylinder allowing gas to leave the gas cylinder and expand into the post and raise the inner post with respect to the outer post. In use, when a user actuates the actuator, the valve opens and the gas from the pressurized gas cylinder enters the post and is sealed therein. The expansion of the gas allows the object supported by the post to rise under pressure. When the user wishes to lower the object, the actuator is actuated opening the valve and pressure downwardly on the object forces gas into the pressurized gas cylinder increasing the pressure in the gas cylinder and lowering the object by allowing the inner and outer posts to telescope inwardly with respect to one another.

The actuator is configured to require a user to take multiple actions to actuate movement of the table.

Figure 8:
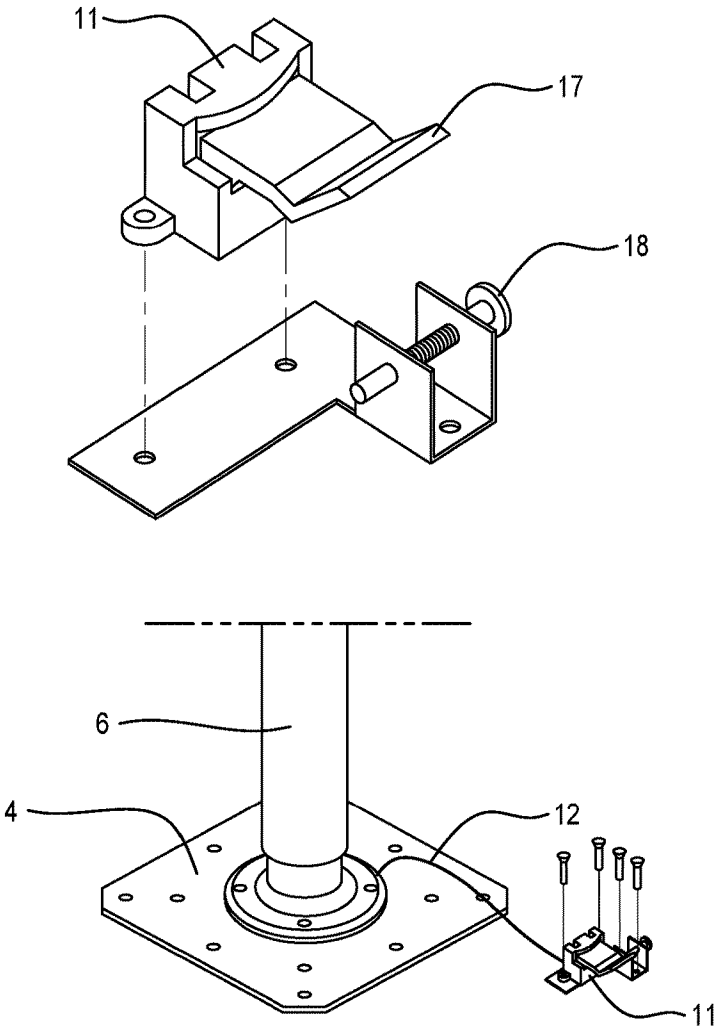
FIG. 8 shows a perspective view of an actuator of one embodiment of the disclosure.
Figure 10:
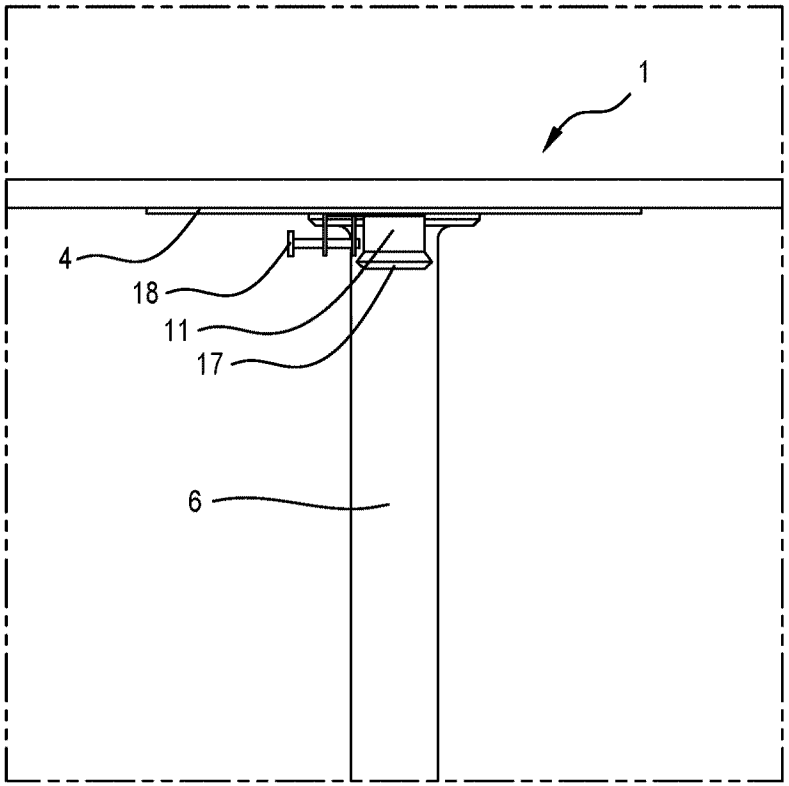
FIG. 10 shows a side view of the embodiment of FIG. 4.
Figure 9:
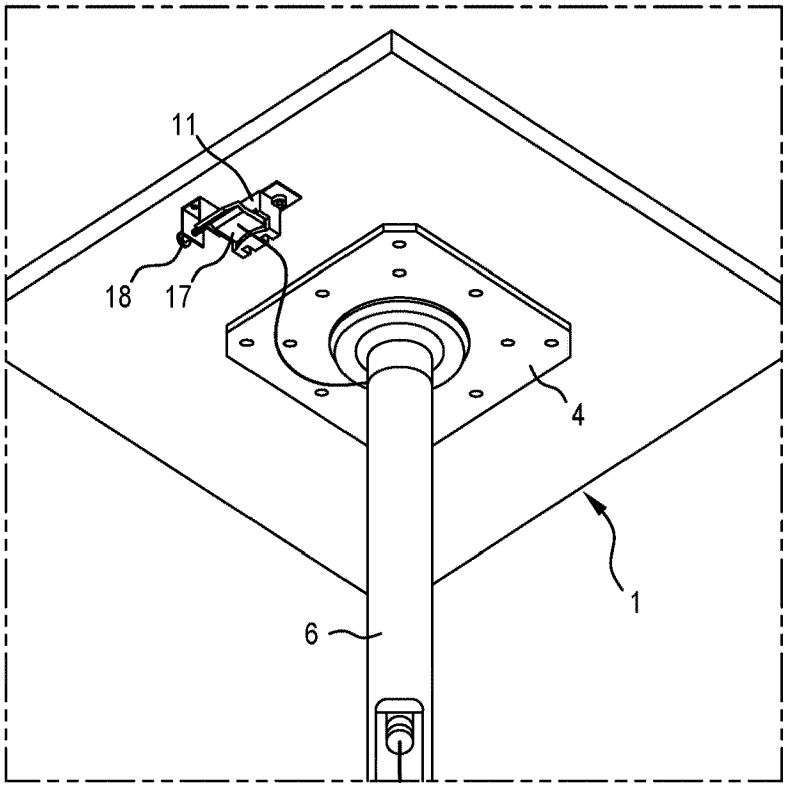
FIG. 9 shows a lower perspective view of the embodiment of FIG. 4.

Referring now to FIG. 8, in the illustrated form the actuator 11 comprises two actuating portions which are moveable in different directions or through different actions to allow actuation of the support structure to move. The actuator 11 comprises an actuation handle including a lever 17 which is angularly moveable or pressable to actuate movement of the support system upwardly or downwardly. The actuator 11 further comprises a release mechanism 18 which must be released to allow actuation through the actuation handle. In the illustrated form, the release mechanism is a pin pulled laterally while the lever is moved upwardly for movement to occur. In other forms the release mechanism is a sliding mechanism or any other mechanism that requires actuation. As shown clearly in FIGS. 9 and 10, actuation requires two actions of the user.

This has the benefit of providing safety and ensuring the table or other object is not accidentally raised or lowered. A user must actively elect to release the release mechanism and press the lever. However, the actuation is able to be single handed which allows for ease of adjustment. By varying the time of actuation (i.e the time the actuator is held in the actuating position), a user can adjust the height to any desired level within the minimum and maximum positions of the structure.

Figure 11:
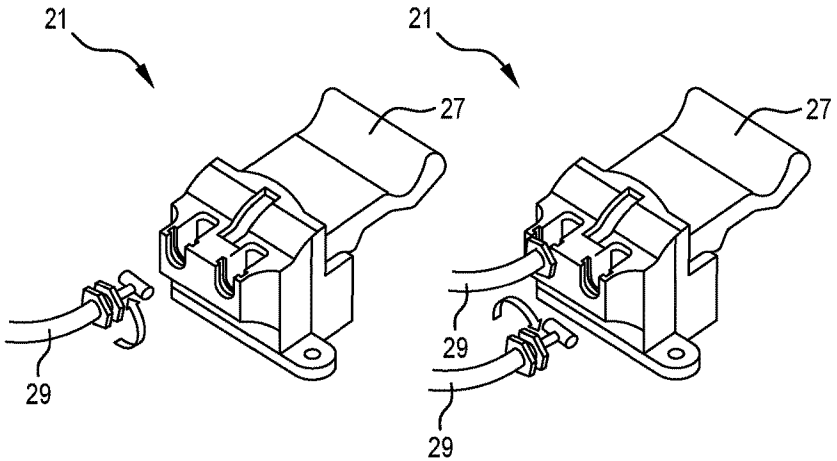
FIG. 11 shows a perspective view of an actuator of a further embodiment of the disclosure.

Referring to FIG. 11, an actuator 21 which can be engaged with multiple post structures is disclosed. The actuator 21 comprises a single lever 27 and a single release mechanism but includes multiple connection cables 29 to connect the actuator 21 with multiple posts.

In use actuation of the actuator results in raising or lowering multiple posts simultaneously. This allows for raising or lowering larger objects or larger table tops or multiple objects that need to be aligned side by side.

Figure 12:
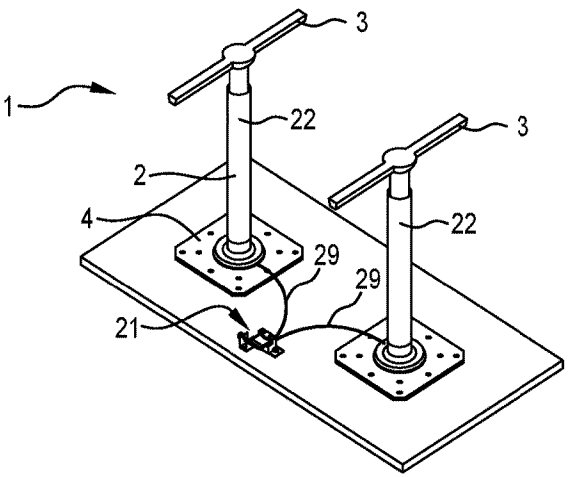
FIG. 12 shows a perspective view of a further embodiment of the disclosure.

Referring to FIG. 12, multiple support structures 22 can be utilized to support one or more objects. Each support structure is part of an extendable support system 1 for supporting an object above a surface such as, for example, the floor or ground. The extendable support system 1 comprises a support structure 2 which is configured to extend between a base 3 and a top plate 4.

Figure 14:
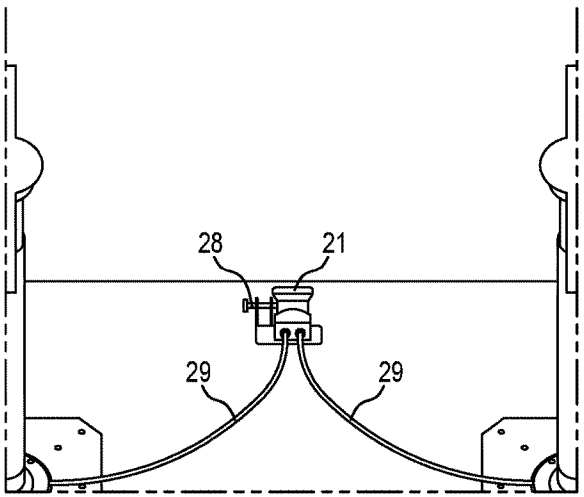
FIG. 14 shows a perspective lower view of an actuator in use.
Figure 13:
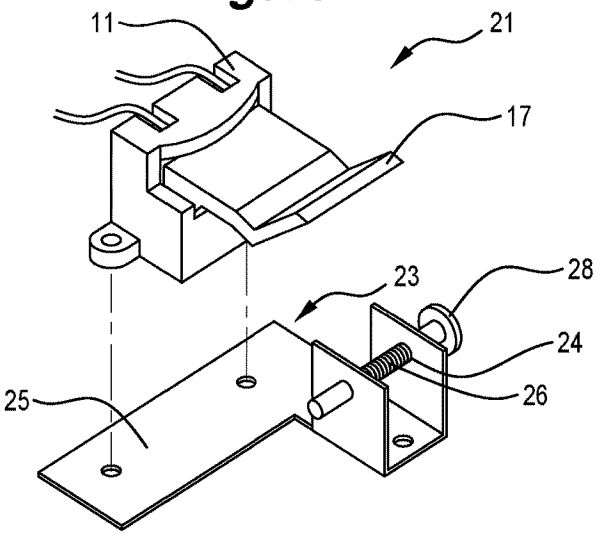
FIG. 13 shows a perspective view of an actuator and bracket of a further embodiment of the disclosure.

Referring to FIGS. 13 and 14, an actuator 21 is engaged with an object such as a table top via a bracket 23 which retains the release mechanism 28. In this form the release mechanism 28 is in the form of a pin although various other release mechanisms are available such as a slide mechanism. In the illustrated form the release mechanism 28 is supported by two plates 24 spaced apart and located on a bracket 25, the plates 24 having an aperture extending therethrough to support the mechanism 28. The bracket 25 may be engaged with the actuator 21. In this illustrated form the mechanism 28 is biased into a locked or closed configuration by a spring 26 although other biasing means are included within the scope of the disclosure.

The multiple support structures 22 are connected to a single actuator 21 to allow control of both support structures simultaneously. This has benefits for dual control and simplicity in various arrangements of supported objects or table tops.

Figure 16:
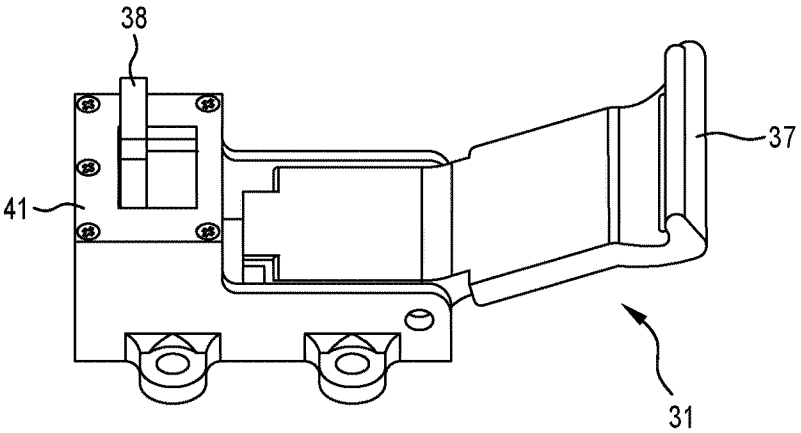
FIG. 16 shows a perspective view of the embodiment of FIG. 15.
Figure 15:
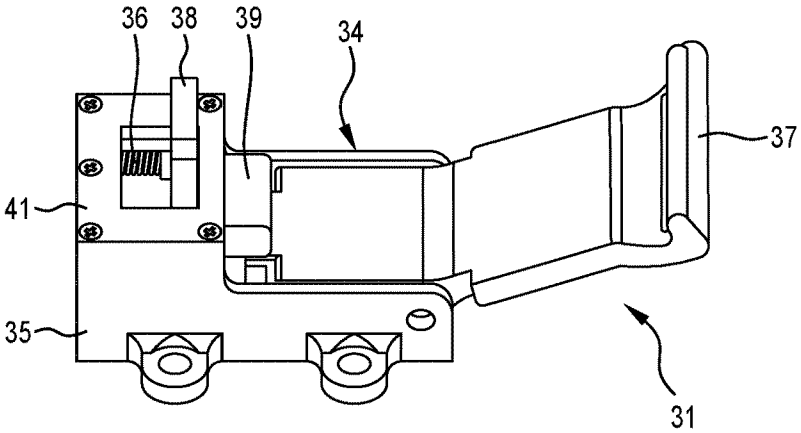
FIG. 15 shows a perspective view of an alternative embodiment of an actuator of a further embodiment of the disclosure.
Figure 17:
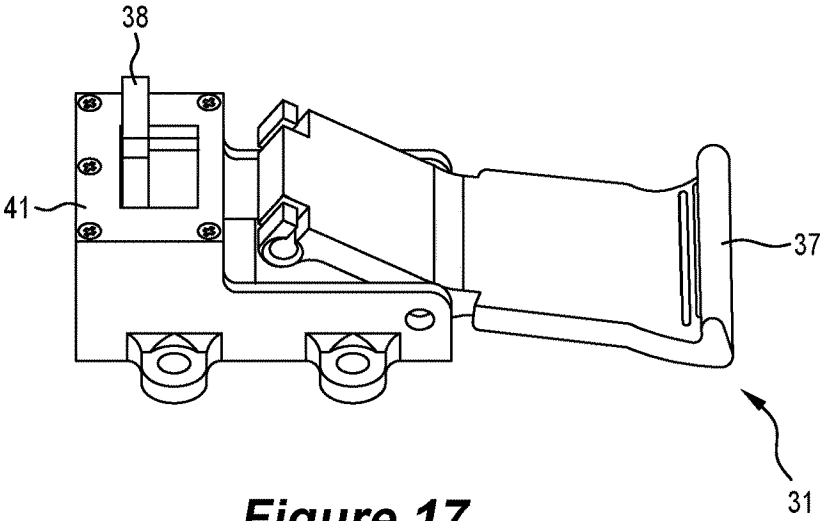
FIG. 17 shows a perspective view of the embodiment of FIG. 15.

Referring to FIGS. 15 through 17, an alternative embodiment of an actuator 31 is shown, In this embodiment the actuator 31 comprises a lever 37 which is moveable to actuate opening of a valve (not illustrated) to control extension and contraction of the post. Movement of the actuator is limited by a release mechanism 38 which in this embodiment is in the form of a slide that is moveable to release and to lock the lever 37. The release mechanism 38 may be supported by a portion 35 of an actuator body 41, while the handle is supported by another portion 34 of the actuator body 41. The release mechanism may be biased into the locked configuration shown in FIG. 15 by a spring or similar biasing member 36. In this configuration a locking member 39 is in contact with a portion of the lever 37. In the release configuration shown in FIG. 16, the locking member is retracted allowing the lever to move freely.

This has the benefit of providing safety and ensuring the table or other object is not accidentally raised or lowered. A user must actively elect to release the release mechanism and press the lever. However, at least in this form the actuation is able to be single handed which allows for ease of adjustment. By varying the time of actuation (i.e the time the actuator is held in the actuating position), a user can adjust the height to any desired level within the minimum and maximum positions of the structure.

Figure 19:
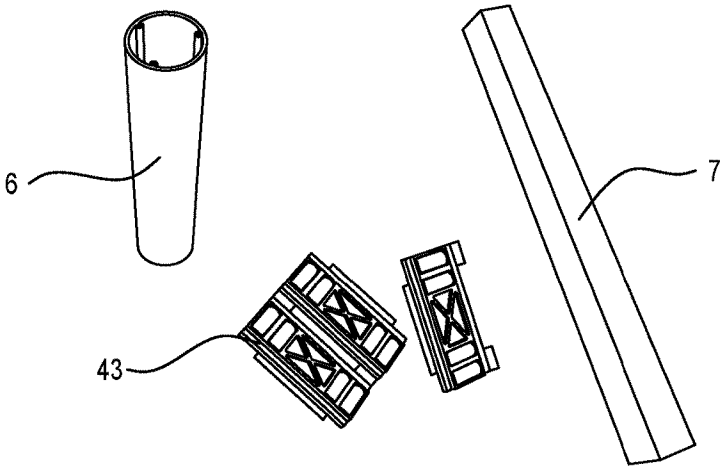
FIG. 19 shows a perspective view of posts and guides according to the embodiment of FIG. 18
Figure 18:
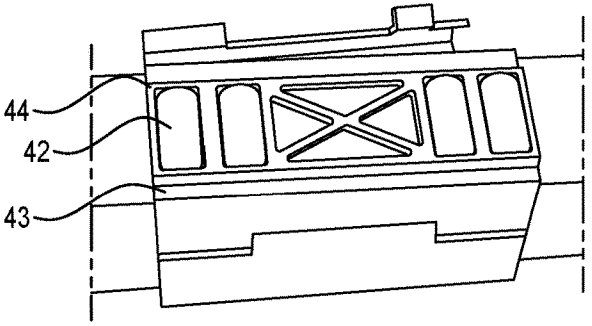
FIG. 18 shows a perspective view of guides according to one embodiment of the invention.

Referring now to FIGS. 18 and 19, guides 41 are located between the inner post and the outer post to allow movement of the inner post 7 with respect to the outer post 6 in a longitudinal direction along the length of the support structure.

Figure 20:
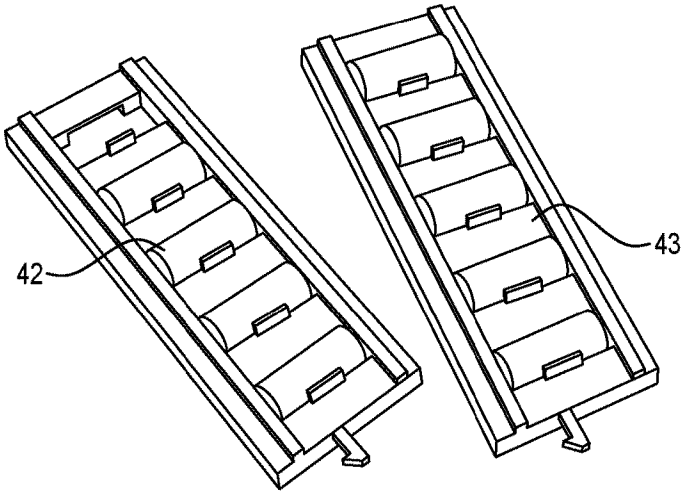
FIG. 20 shows a perspective view of guides according to a further embodiment of the invention.

In the form illustrated in FIGS. 18 and 19, the guides 41 are in the form of rollers 42 that are oriented to allow longitudinal movement. The rollers 42 are spaced apart around the inner post and positioned with respect to the post by means of a roller frame 43. The use of a frame allows placement of any number of rollers as a single unit. Multiple units of the frame with rollers can then be arranged as desired at different locations) to obtain maximum stability and improved operation. In some forms greater than 8 cylindrical rollers may be utilized. In some forms the rollers are utilized in an array with an equal number of rollers on each contacting side with respect to the post. For example, in this illustrated form, 12 cylindrical rollers float in position with respect to the posts but it will be understood any number of rollers may be utilized as shown in FIG. 20 which shows rollers 42 in a frame 43 which can be positioned around a post. The use of rollers offers reduced friction between the inner and outer posts while executing the basic function of guiding the outer post during extension. The reduced friction between the inner and outer post will result in reduced wear of parts in turn resulting in longer service life.

The frame includes cavities 44 for positioning the floating rollers 42.

The rollers may be of various materials including polymers, rubber, ceramics and metal. This will allow fabrication of systems with varied capabilities and improved service life.

In some forms the guides are located proximal top and bottom ends of the support structure. In some forms the guides are positioned in multiple arrays located and spaced apart around the post. The guides proximal to the bottom ends may be arranged along the outer surface of the inner post such that their positions around the post form an array that is triangular in shape. Alternatively, the array may be square or diamond or otherwise shaped. Similarly, the guides proximal to the top end may be arranged along the outer surface of the inner post in a manner such that their position forms an array having a shape that is inverted to the shape formed by the guides placed proximal to the bottom end. For example, the shape may be an inverted triangle with respect to that at the bottom of the post. Such an arrangement supports the outer post throughout the movement of the post.

Variations and modifications may be made to the parts previously described without departing from the spirit or ambit of the disclosure.

For example the inner post and outer post may be reversed, the inner post and outer post may be any shape, the guides may be in the form of balls, cylinders, slides or other guides encouraging movement in a set of opposite directions.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An extendable support system for supporting an object on a surface, the support system comprising:

a support structure comprising an inner post and an outer post arranged such that the relative longitudinal position of the inner post and the outer post effects a change in an overall length of the support structure to vary the height of the object above the surface;

a guide assembly comprising one or more guides positioned between the inner post and the outer post, the guides being configured to maintain the lateral position of the inner post and the outer post with respect to one another while allowing longitudinal movement of the inner post and outer post with respect to one another along the length of the support structure, and an actuator adapted to actuate movement of the inner post with respect to the outer post, actuation of the actuator requiring at least a first and a second actuation motion by a user, the first and second actuation motions being in different directions.

2. An extendable support system as defined in claim 1 wherein the guides comprise rollers aligned to allow longitudinal movement of the inner post with respect to the outer post along a length of the support structure.

3. An extendable support system as defined in claim 2 wherein the rollers are cylindrical in shape.

4. An extendable support system as defined in claim 1, wherein the one or more guides are made from a polymeric, metallic or a ceramic material.

5. An extendable support post system as defined in claim 1 wherein the guides are spaced apart around an internal surface of the outer post.

6. An extendable support system as defined in claim 5 wherein the guides are located proximal an upper end of the outer post and proximal a lower end of the outer post.

7. An extendable support system as defined in claim 1 wherein the guides are floating along at least a portion of the length of the outer post.

8. An extendable support system as defined in claim 1 wherein the guide assembly comprises of guides that are fixed to an internal surface of the outer post.

9. An extendable support system as defined in claim 1 wherein the direction of the first actuation motion and the direction of the second actuation motion are transverse to one another.

10. An extendable support system as defined in claim 1, wherein the first actuation motion comprises movement of a release mechanism.

11. An extendable support system as defined in claim 1, wherein the first actuation motion and the second actuation motion can be performed by a single hand.

12. An extendable support system as defined in claim 1, wherein the actuator is configured to be connected to more than one support structure to actuate movement in those support structures.

* * * * *